US005095549A

United States Patent [19]

Aldridge

[11] Patent Number: 5,095,549

[45] Date of Patent: Mar. 17, 1992

[54] FIREFIGHTER PANT SUPPORT SYSTEM

[75] Inventor: Donald Aldridge, New Carlisle, Ohio

[73] Assignee: Lion Apparel, Inc., Dayton, Ohio

[21] Appl. No.: 619,784

[22] Filed: Nov. 29, 1990

[51] Int. Cl.[5] ..... A41F 19/00

[52] U.S. Cl. ..... 2/304; 2/102; 2/81; 2/69.5; 2/70

[58] Field of Search ..... 2/304, 102, 81, 69.5, 2/70

[56] References Cited

U.S. PATENT DOCUMENTS

| | | | |
|---|---|---|---|
| 932,640 | 8/1909 | Pfiffner | 2/70 |
| 1,156,187 | 4/1913 | Smedberg | 2/102 |
| 1,736,224 | 9/1928 | Slate | 2/70 |
| 4,843,646 | 7/1989 | Grilliot et al. | 2/69 |

FOREIGN PATENT DOCUMENTS

| | | | |
|---|---|---|---|
| 4437 | 2/1901 | Austria | 2/102 |
| 28041 | of 1907 | United Kingdom | 2/102 |

*Primary Examiner*—Werner H. Schroeder
*Assistant Examiner*—Glona Hale
*Attorney, Agent, or Firm*—Thompson, Hine and Flory

[57] ABSTRACT

A firefighter pant support system for use with firefighter pants having an outer sheel of a fire and moisture resistant material and an inner liner of a heat resistant material wherein the inner liner is removable from the outer shell. The support system includes a vest member having a body preferably made of a heat-resistant open mesh, and a waistband having a plurality of button holes for receiving fasteners, such as buttons or fastener studes, such that the vest member supports the pant liner and outer shell when worn by a user. In an alternate embodiment, the vest member is stitched permanently to the liner to make a jump pant. The vest member distributes the weight of the pant liner and pant shell over a broader area than conventional suspenders, provides a layer of thermal protection for the upper body of the wearer and can carry reflective trim detectable when the wearer removes his firefighter coat.

27 Claims, 2 Drawing Sheets

FIREFIGHTER PANT SUPPORT SYSTEM

BACKGROUND OF THE INVENTION

The present invention relates to firefighter garments and, more particularly, to systems for supporting the pant liner and pant shell component of a firefighter garment.

Firefighter garments typically comprise a coat and pant, each having an outer shell made of a heat and moisture resistant material and an inner, removable lining made of a heat-insulating material. The inner lining also includes a moisture barrier, and is easily separable from the shell for cleaning, since the outer shell often requires a stronger cleaning solution than the liner.

In order to provide full protection against the extreme heat and flame hazards encountered by a firefighter, both the shell and liner must be worn. However, firefighters occasionally remove the inner lining, either in the belief that it is not required for the particular task at hand or because the firefighter anticipates working in warm weather in which the liner would act to trap heat and prevent air circulation. Unfortunately, the firefighter who removes the inner liners of his pant or jacket runs the risk of sustaining sever injury should he sustain an unexpected flame or blast of hot air.

Accordingly, firefighter pants and jackets are designed to discourage the wearing of the shells without the liners. With respect to the pant, one method of discouraging liner removal is to design the pant so that the liner carries buttons which engage button holes formed in the outer shell. Both the pant liner and shell are supported on the wearer by suspenders which attach to the buttons. Since the suspenders provide the only means for supporting the shell, it is not possible to wear the pant shell without wearing the pant liner as well since the pant liner carries the buttons that engage the suspenders.

A disadvantage with such apparel is that the weight of the pant and liner bear on the suspenders and may chafe or otherwise cause discomfort to a wearer. Accordingly, there is a need for an alternative to a pant and suspender system which provides a greater degree of comfort than suspenders yet discourages the wearing of the pant shell without its liner.

SUMMARY OF THE INVENTION

The present invention is a firefighter pant support system which is used with a firefighter pant having an inner, thermal liner which is separable from an outer, flame-resistant shell. The system includes a vest member having a body preferably made of a heat-resistant open mesh, which is attachable to the pant liner and acts as a support for the liner and shell, distributing the weight of the pant over a larger area than conventional suspenders. Further, the vest design does not slip or fall off the shoulders of the wearer as easily as conventional suspenders.

In a preferred embodiment of the invention, the vest member is permanently attached to the liner and is made of an aramid woven in an open mesh which provides a layer of thermal protection to the torso of the wearer, thereby reducing the insulation requirements of the jacket liner. Further, the vest member promotes air circulation beneath the jacket liner to reduce heat stress of the wearer. The vest member preferably includes strips of reflective material so that the wearer has a higher degree of visibility in low-light conditions when only the pant and vest member are worn.

In an alternate embodiment, the vest member comprises a separable component of a suspension system and includes a waistband having buttonholes or other openings to receive fastening means—such as buttons or snap studs—carried on the liner. With such an embodiment, the vest member need not be made of a heat resistant material.

Accordingly, it is an object of the present invention to provide a firefighter pant support system which increases wearing comfort; a pant support system which provides a measure of thermal protection to reduce the insulation requirements of the jacket liner; a pant support system which discourages the wearing of the outer pant shell without the complementary liner; and a pant support system which provides a higher visibility in low-light conditions when the wearer has removed his firefighter jacket.

Other objects and advantages will be apparent from the following description, the accompanying drawings and the appended claims.

DETAILED DESCRIPTION

Figure 1:
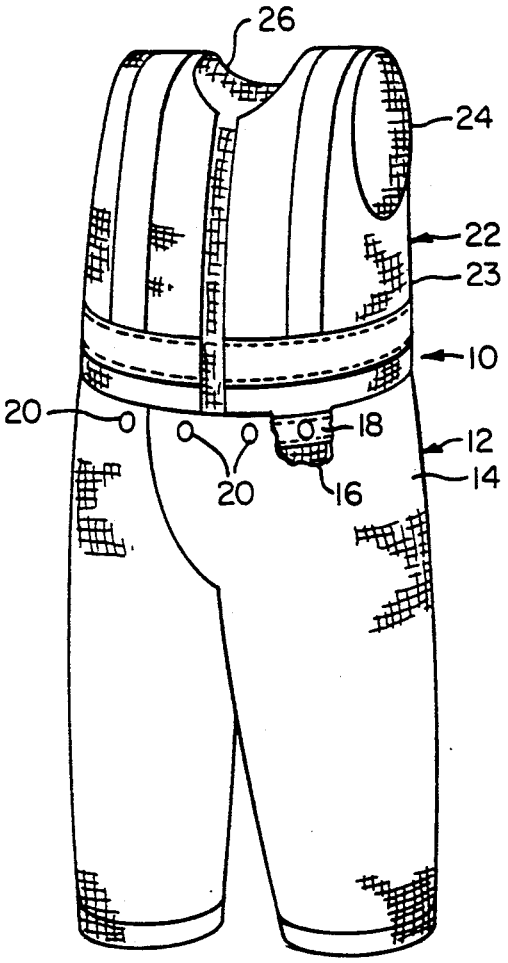
FIG. 1 is a front, perspective view of a preferred embodiment of the firefighter pant support system of the present invention in which a portion of the pant shell is cut away to reveal the waistband of the vest member.
Figure 2:
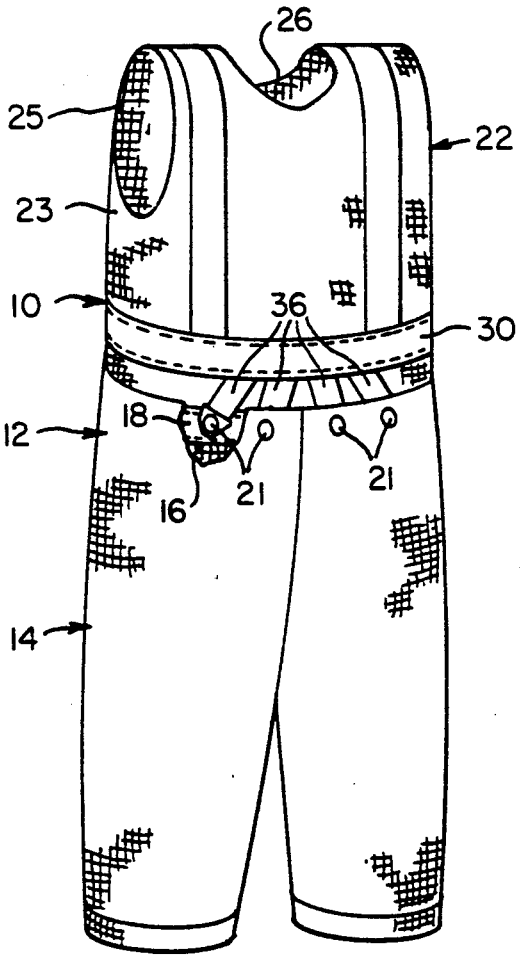
FIG. 2 is a rear perspective view of the system of FIG. 1 in which a portion of the pant shell is cut away to reveal the pant liner.

As shown in FIGS. 1 and 2, the firefighter pant support system of the present invention, generally designated 10, utilizes a conventional firefighter pant 12 having an outer shell 14 and a removable, inner liner 16. The outer shell preferably is made of a flame and moisture-resistant material such as Nomex III fibers, Kevlar fibers or fibers comprising a blend of Kevlar and PBI (polybenzimidazole). Kevlar and Nomex III are trademarks of E. I. Du Pont de Nemours & Co., Inc., Wilmington, Delaware for aramid fiber compositions, and PBI is a registered trademark of Celanese Corp., New York, New York. The inner liner 16 is made of a heat and moisture-resistant material, such as a Nomex face cloth quilted to Nomex batting, or a thermal liner such as that disclosed in Lapedes et al. U.S. Pat. No. 4,502,153, the disclosure of which is incorporated herein by reference.

The liner 16 includes a waistband 18 ,having sets of front and rear buttons 20, 21, respectively. The outer shell 14 is attached to the inner liner by the engagement of the buttons 20, 21 with button holes (not shown) formed in the outer shell.

The support system 10 also includes a vest member 22. Vest member 22 includes a body portion 23 shaped to enclose a wearer's torso and having left and right arm openings 24, 25, respectively, and neck opening 26. Vest member 22 is attached to the pant 12 and provides a support for the pant when worn. While it is preferable to fabricate the vest member 22 from a heat resistant material such as Kevlar or Nomex, it is not necessary to do so with the embodiments of FIGS. 1-6. An acceptable material with such embodiments is polyester. Whichever material is selected, it preferably is woven in an open mesh.

Figure 3:
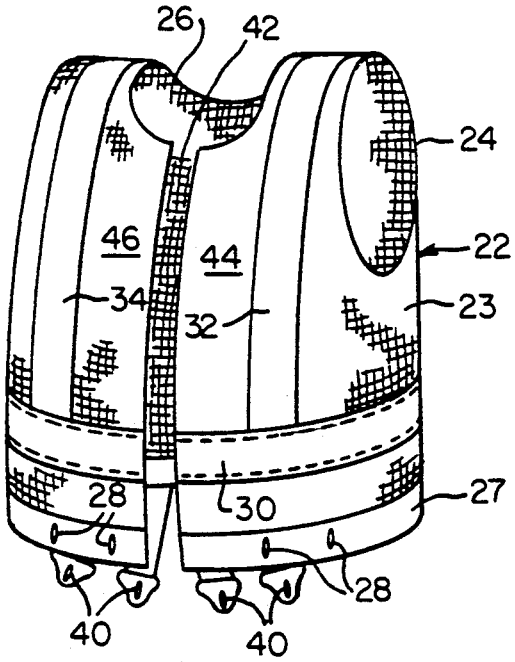
FIG. 3 is a front perspective view of the vest member of the support system of FIG. 1.
Figure 4:
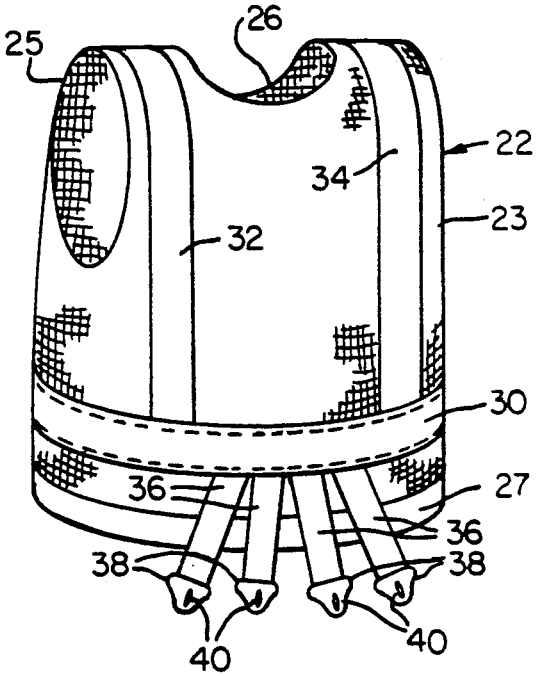
FIG. 4 is a rear view of the vest member of FIG. 3.

As shown in FIGS. 3 and 4, the vest member 22 includes a waistband 27 which extends about a lower periphery of, and is attached to, the body portion 23. Waistband 27 includes a plurality of button holes 28 spaced about the front portion of the vest member 22 and positioned to receive corresponding ones of the front buttons 20.

The vest member 22 also includes a peripheral chestband 30 and left and right shoulder straps 32, 34, respectively, made of a reflective material such as Scotchlite material (Scotchlite is a registered trademark of 3M Company, Minneapolis, Minnesota). Chestband 30 and shoulder straps 32, 34 are stitched to the body portion 23 of the vest member 22 and provide high visibility to the wearer when the system 10 is worn without a firefighter jacket.

Four rear support straps 36 are attached to a rear portion of the chestband 30 and adjacent body portion 23 and extend downwardly from the chestband to terminate in leather tabs 38, each having a button hole 40 formed therethrough. As shown in FIG. 2, straps 36 are connected to rear buttons 21 of the liner 16 to support the pant 12 in the rear.

The body portion 23 includes a vertical front opening 42 which divides the body portion into left and right chest panels 44, 46, respectively.

Figure 5:
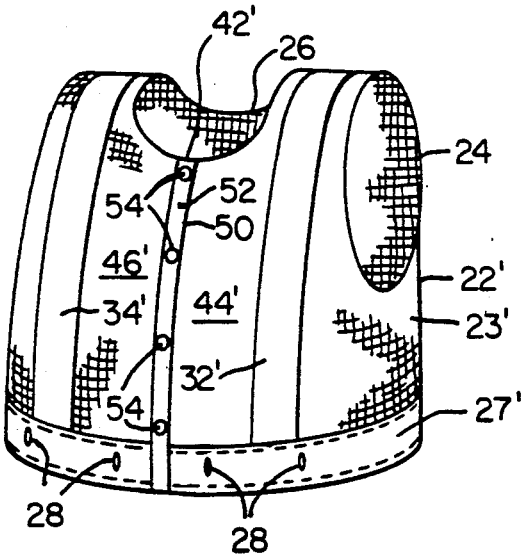
FIG. 5 is a front perspective view of an alternate embodiment of the vest member of the invention.
Figure 6:
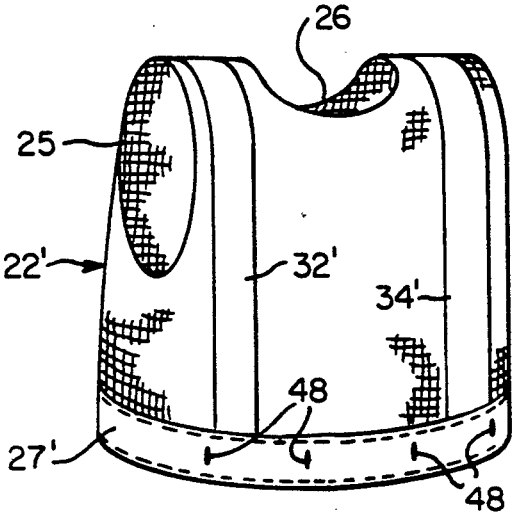
FIG. 6 is a rear perspective view of the vest member of FIG. 5.

FIGS. 5 and 6 show an alternate embodiment of vest member 22' which is modified from the embodiment shown in FIGS. 3 and 4 in that it includes a waistband 26' having rear button holes 48 which engage rear buttons 21 of the liner 16 (see FIG. 2). Shoulder straps 32', 34'extend downwardly to the waistband 26'.

The vest member 22' includes a body portion 23' in which the vertical opening 42' includes a closure 50 which comprises a strip 52 of material attached to the edge of left chest panel 44'. Right chest panel 46' includes buttons 54 which attach to the strip 52 through button holes (not shown) formed thereon. Alternatively, the closure 50 could comprise snaps, hook and loop members or buckles, and not depart from the scope of the invention.

Figure 7:
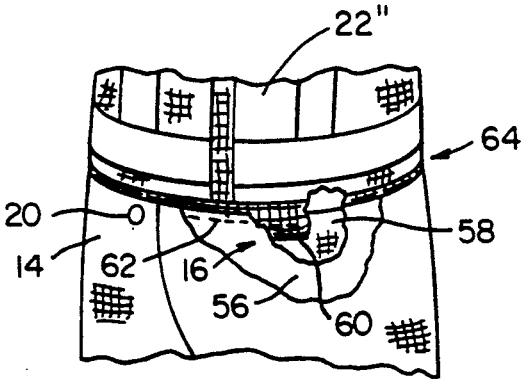
FIG. 7 is a detail of a jump pant of a preferred embodiment of the invention broken away to show the connection between the vest and pant liner.

Another embodiment of the invention is shown in FIG. 7 in which the vest member 22'' is permanently attached to the inner pant liner 16. The inner liner 16 includes a moisture barrier layer 56 attached to an insulation layer 58, arranged so that the moisture barrier is outside of the insulation layer. The moisture barrier layer 56 preferably comprises a substrate of, for example, Nomex and Kevlar or polyester and cotton, carrying a layer of Gore-Tex or neoprene (Gore-Tex is a registered trademark of W. L. Gore & Associates, Inc.). The insulation layer 58 preferably comprises Nomex face cloth quilted to Nomex and Kevlar.

The bottom end 60 of the vest member 22'' is doubled over and inserted in between the moisture barrier layer 56 and the insulation layer 58. The layers 56, 58 and end 60 are then connected by stitching 62 to form a jump pant 64. Accordingly, jump pant 64 is a two-piece structure comprising a unitary vest member 22'' and liner 16, and an outer shell 14. The shell 14 is supported by the buttons 20 attached to the liner 16 as in the embodiment of FIG. 1. Since vest member 22'' is unitary with liner 16, it must be made of a heat resistant material, preferably Kevlar or Nomex, woven in an open mesh.

Figure 8:
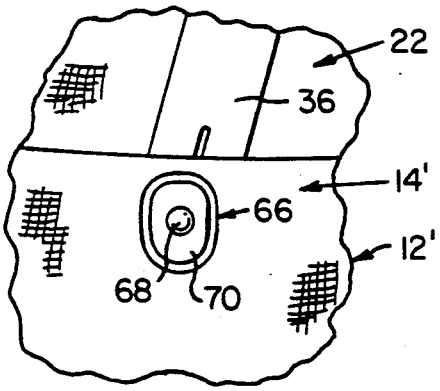
FIG. 8 is a detail of a jump pant of a preferred embodiment of the invention showing an alternate fastening mechanism.

FIG. 8 shows an alternate embodiment of the support system 10 shown in FIG. 2. The structure of the system is identical to that of FIG. 2 except that socket and stud fastener 66 are used instead of buttons 20. In this embodiment, a two prong clinch-type stud 68 is attached to the inner pant liner (not shown) and a socket 70 is attached to the outer shell 14' of the pant 12'. An example of such a fastener is a LIFT-THE-DOT brand fastener sold by TRW Inc.

With such a fastener 66, the button holes 28, 40 (see FIG. 3) of the waistband 18 (see FIG. 1) and rear strap 36 receive the stud 68 and are secured thereon by the socket 70 attached to the outer shell 14'.

When used, the vest member 22 is attached to the liner 16 by engagement with the buttons 20 of the liner, which also are connected to the outer shell 14. The user steps into the pant 12 through the open vest member 22, then pulls the pant and vest up over his legs and inserts his arms through the armholes 24, 25. The vest member 22 holds the pant 12 up and distributes the weight of the pant over the shoulder area of the wearer. The wearer is discouraged from removing the liner 16 and wearing only the shell 14 since the buttons (or studs in the embodiment of FIG. 8) are attached to the liner and the connection between the vest member 22 and shell 14 cannot be made without the liner buttons or studs.

The vest member 22 not only provides a support function for the pant, thereby eliminating the need for uncomfortable suspenders, but the open mesh material of the body portion 23 provides a thermal barrier which may reduce the required thickness of the liner component of an associated coat. Further, the open mesh allows perspiration of the wearer to evaporate more easily, thereby reducing thermal stress of the wearer in a high-temperature environment. The reflective trim is advantageous in that the support system may be worn without the accompanying jacket when, for example, the wearer is directing traffic at the scene of an emergency, in which event the vest member 22 provides high visibility, especially in low-light situations.

While the forms of apparatus herein described constitute preferred embodiments of this invention, it is to be understood that the invention is not limited to these precise forms of apparatus, and that changes may be made therein without departing from the scope of the invention.

What is claimed is:

1. A pant support system for use with firefighter pants having an outer shell of fire and moisture-resistant material and an inner liner of a heat resistant material, said inner liner having means for attachment to said outer shell, the pant support system comprising:

a vest member; and means for connecting said vest member to said inner liner, whereby said inner line and said outer shell are supported by said vest member when said vest member, said inner liner and said outer shell are worn by a user.

2. The system of claim 1 wherein said vest member includes a body made of an open mesh.

3. The system of claim 2 wherein said open mesh comprises a heat-resistant material.

4. The system of claim 3 wherein said material comprises an aramid fiber.

5. The system of claim 1 wherein said connecting means is connectable to said attachment means.

6. The system of claim 5 wherein said connecting means includes a plurality of button holes shaped to receive buttons attached to said inner liner.

7. The system of claim 6 wherein said buttons comprise said attachment means.

8. The system of claim 1 wherein said vest member includes a bottom peripheral waistband, said waistband having said connecting means.

9. The system of claim 1 wherein said vest member is attached at a bottom end thereof to said inner liner by stitching.

10. The system of claim 9 wherein said inner liner includes an outer moisture barrier layer and an inner thermal layer, and said bottom end is secured between said outer moisture barrier layer and said inner thermal layer by said stitching.

11. The system of claim 8 wherein said connecting means includes a plurality of button holes formed in and spaced along said waistband.

12. The system of claim 11 wherein said connecting means includes a plurality of straps extending between said vest member and said attachment means.

13. The system of claim 12 further comprising a chestband attached to and extending about an outer periphery of said vest member above said waistband, said straps being attached to said chestband and said body.

14. The system of claim 13 wherein said chestband comprises reflective material.

15. The system of claim 14 wherein said vest member includes left and right chest panels, and said system further comprises left and right shoulder straps extending about said shoulder portions and comprising reflective material.

16. The system of claim 1 wherein said vest member includes a substantially vertical front opening.

17. The system of claim 1 wherein said vest member includes closure means for closing said front opening.

18. The system of claim 14 wherein said closure means includes buttons.

19. The system of claim 1 wherein said vest member includes reflective means.

20. The system of claim 6 wherein said attachment means includes a stud attached to said inner liner and a complementary socket attached to said outer shell, said connecting means comprising holes in said vest member shaped to receive said studs therethrough.

21. A pant support system comprising:

an outer pant shell made of a fire and heat resistant material, said outer shell having a plurality of button holes spaced about a waistline thereof;

an inner pant liner positioned within said shell and made of a heat resistant material and having a plurality of buttons spaced about a waistline thereof and positioned to engage said button holes such that said liner is positively attached to and supports said shell; and a vest member having a body made of a heat resistant open mesh, a vertical front opening and a waistband attached to and extending about a bottom periphery of said body and having a plurality of button holes spaced to receive said inner pant liner buttons therethrough such that said vest member supports said inner liner and outer shell, when worn by a user.

22. The system of claim 21 further comprising a chestband spaced above said waistband and attached to said body, said chestband including support straps attached to a rearward portion of said chestband and including button holes positioned to receive rearward ones of said liner buttons.

23. The system of claim 22 further comprising left and right shoulder straps extending about and attached to left and right shoulder portions of said body, said shoulder straps being attached to said vest member body.

24. The system of claim 24 wherein said chestband and said shoulder straps include a reflective component.

25. The system of claim 21 further comprising a button closure for closing said front opening.

26. A jump pant system comprising:

an outer pant shell made of a fire and heat resistant material, said outer shell having a plurality of first fastener means spaced about a waistline thereof;

an inner pant liner having an outer moisture barrier layer and an inner thermal layer attached to said outer moisture barrier layer, said inner liner having second fastener means, complementary to said first fastener means, spaced about a waistline of said inner liner; and a vest member having a body, made of a heat resistant open mesh, a vertical front opening and a bottom, said bottom and being end attached to and integral with said inner liner.

27. The system of claim 26 wherein said bottom end is received between said inner and outer layers of said inner pant liner.

* * * * *